US010267341B2

(12) United States Patent
Marsch et al.

(10) Patent No.: US 10,267,341 B2
(45) Date of Patent: Apr. 23, 2019

(54) END POSITION DETECTION OF A VARIABLE HYDRAULIC MACHINE

(71) Applicant: Danfoss Power Solutions GmbH & Co. OHG, Neumunster (DE)

(72) Inventors: Suenje Marsch, Ehndorf (DE); Rolf Rathke, Hohn (DE); Stephan Kaiser, Neumünster (DE); Edat Kaya, Hamburg (DE)

(73) Assignee: Danfoss Power Solutions GmbH & Co. OHG, Neumunster (DE)

( * ) Notice: Subject to any disclaimer, the term of this patent is extended or adjusted under 35 U.S.C. 154(b) by 405 days.

(21) Appl. No.: 15/076,964

(22) Filed: Mar. 22, 2016

(65) Prior Publication Data

US 2016/0282143 A1 Sep. 29, 2016

(30) Foreign Application Priority Data

Mar. 26, 2015 (DE) ..... 10 2015 205 548

(51) Int. Cl.

| | |
|---|---|
| ***F04B 1/20*** | (2006.01) |
| ***F04B 1/32*** | (2006.01) |
| ***F04B 49/06*** | (2006.01) |
| ***F15B 11/10*** | (2006.01) |

(52) U.S. Cl.

CPC ..... *F15B 11/10* (2013.01); *F04B 1/2014* (2013.01); *F04B 1/32* (2013.01); *F04B 1/328* (2013.01); *F04B 49/06* (2013.01)

(58) Field of Classification Search

CPC ..... F15B 11/10; F04B 49/06; F04B 1/328; F04B 1/2014; F04B 1/32

USPC ..... 324/260, 652; 345/441; 701/64

See application file for complete search history.

(56) References Cited

U.S. PATENT DOCUMENTS

| | | | | |
|---|---|---|---|---|
| 7,878,084 | B2 * | 2/2011 | Petzold | F16H 59/68 701/64 |
| 2007/0137475 | A1 * | 6/2007 | Reimer | F01B 3/0002 91/505 |
| 2007/0241298 | A1 * | 10/2007 | Herbert | F16K 7/16 251/129.04 |

FOREIGN PATENT DOCUMENTS

| | | | |
|---|---|---|---|
| CN | 101750531 | A | 6/2010 |
| CN | 101772667 | A | 7/2010 |
| CN | 103017647 | A | 4/2013 |
| DE | 101 19 236 | C1 | 12/2002 |
| DE | 10 2005 060 960 | B3 | 6/2007 |
| JP | 2002297234 | A | 10/2002 |

* cited by examiner

*Primary Examiner* — Farhana A Hoque

(74) *Attorney, Agent, or Firm* — McCormick, Paulding & Huber LLP

(57) ABSTRACT

The invention relates to a method and a device for determining of at least one end position of a displacement element of an adjustable hydraulic machine, in particular of the axial piston type, shiftable or displaceable between two ends position a by means of a displacement unit between a first end position and a second end position. According to the invention the determination of having reached an end position of displacement takes place by means of a measurement circuit, whose electrical characteristics are changed jumpily when an end position is reached. This is done by connecting a partial branch of the measuring circuit with earth, when a moveable element comes into electric contact with a limit stop assigned to the corresponding end position.

20 Claims, 4 Drawing Sheets

END POSITION DETECTION OF A VARIABLE HYDRAULIC MACHINE

CROSS REFERENCE TO RELATED APPLICATIONS

Applicant hereby claims foreign priority benefits under U.S.C. § 119 from German Patent Application No. 10 2015 205 548.5 filed on Mar. 26, 2015, the contents of which are incorporated by reference herein.

TECHNICAL FIELD

The invention relates to a method for detection of at least one end position of displacement element of a hydraulic machine, wherein the displacement element is movable between two end positions. It relates also to a hydraulic machine of the axial piston type having a displacement element displaceable by means of a displacement unit between a first end position and a second end position.

BACKGROUND

The invention is based in particular on an adjustable hydraulic machine of the axial piston type as known exemplarily from DE 10 2005 060 960 B3. This hydraulic machine comprises a cylinder block mounted on a valve segment displaceable in a housing. The valve segment is connected via a rod to a control piston whose movement is electrically controllable by a proportional solenoid. The displacement volume of the hydraulic machine is adjustable by the movement of the valve segment together with the cylinder block.

DE 101 19 236 C1 discloses a largely similar hydraulic machine, whose movement of the displacement element designed as a valve segment together with the cylinder block is limited by adjustment screws at the housing. The adjustment screws form limit stops for the valve segment which define the end positions of displacement.

The hydraulic machines according to the state of the art are usually operated by an electronic control unit which is used to set the displacement of the control piston and therefore the displacement volume of the hydraulic machine. Here it should be considered that the range of displacement of the displacement element together with the cylinder block is limited between two end positions. In fact, the actual position of the control piston is detectable by sensors as exemplarily disclosed in DE 101 19 236 C1, however, there is no reliable and exact indication of an end position of displacement being reached, which can be used by the control unit. Moreover, the use of such sensors incurs increased costs, particularly as these sensors must be calibrated in each hydraulic machine.

SUMMARY

The underlying problem of the invention is to provide a method and a device of the kind mentioned above, whereby, using simple means, it should be possible to accurately and reliably detect when a component of a hydraulic machine, movable between two end positions, has reached one end position.

The problem with regard to the method is solved when the displacement element reaches a particular end position an electrical contact is established between an electrical component assigned to the corresponding end position and an electrical measuring circuit, and in that the changes brought about in the electrical parameters of the measuring circuit are used for the purpose for detecting that the corresponding end position has been reached.

The above mentioned problem is solved with regard to a variable hydraulic machine in that the hydraulic machine comprises electrical components of which one is assigned to a first end position, and another one is assigned to the second end position, thereby forming part of an electronic measuring circuit in the corresponding end position of the displacement element.

A measuring circuit according to the invention is formed by an electric or electronic circuit having a power source, which is connected or connectable via lines or in an electrically conductive manner to electric components, and having evaluation or indication units for detecting, evaluating the currents or voltages in one or more paths of the circuit and outputting and/or indicating them as an output signal. Here, the display unit can be a separate device which is signal-connected to the evaluation unit. Here, the currents in the measuring circuit can be direct or alternating currents. As alternating currents pulse width modulated (PWR) currents are possible, which are used in some hydraulic machines for controlling the solenoid.

In a preferred embodiment of the method, the electrical components can comprise a resistance and/or a capacity and/or an inductivity. The measuring circuit can be a resonant circuit, for example, whose change of frequency or amplitude is detected when the component is connected to it.

Particularly preferable the resistance of the measuring circuit or the current flowing in the measuring circuit should be the detected or monitored electric parameter and the electric component should be an ohmic resistor.

In implementation of the invention the inventive electric components may be arranged at or in those components of the hydraulic machine which come into electrically conductive contact with the valve segment of the cylinder block or any other components involved in the displacement. Examples of this are minimum or maximum screws known as adjustment screws serving as stoppers for the displacement element, e.g. the cylinder block or its yoke or the valve segment of an axial piston machine of the bent axis type or the swash plate of an axial piston machine of the swash plate type. An arrangement at the displacement unit for the cylinder block is possible as well, for instance in a control piston movable between the two end positions, in which the control piston in its correspondent end position establishes a contact between the components and an electrically conductive part of the hydraulic machine. Needless to say that the inventive arrangement can be used as well merely for the determination of a single end position and is transferrable in an analogues manner for instance to radial piston machines.

In implementation of the invention it is preferable for the hydraulic machine to comprise a displacement unit for the valve segment of the cylinder block or the swash plate which can be actuated via a solenoid and that the solenoid is part of the measuring circuit. Here it is advantageous if the hydraulic machine is operated by an electronic control unit, via which the current through the solenoid can be set and monitored.

In a further preferred embodiment of the invention, the hydraulic machine comprises one adjustment screw for determining each end position, the first and the second end position of the displacement element, whereby a first contact of an electric component is arranged isolated from a contact surface of the adjustment screw, the contact surface being contactable by electrically conductive parts of the hydraulic machine when the corresponding end position is reached.

When reaching the end position of the displacement element, the first contact of the electric part is connected to earth such that an electric current can flow through the component. This additionally flowing current is provided by the current or power source of the measuring circuit, which is operatively connected with a second contact of the electric component. This current or power source can advantageously be way the current or power source of the solenoid that is present anyway. The occurrence of the additional current, which only starts to flow when the end position is reached, is detected by the evaluation unit of the measuring circuit and is provided as a signal. The evaluation unit of the measuring circuit can be integrated into the electronic control unit of the hydraulic machine.

In implementation of the invention it is particularly preferable for the second contact of the electric component to be connected in an electrically conductive manner to the solenoid. Hence, this contact comprises the same current or power supply as the solenoid and uses the control and monitoring of the current through the solenoid provided by the hydraulic machine anyway, in that the solenoid is used as a component of the measuring circuit. For completion of the measuring circuit, only a further electric component is necessary then, preferably an ohmic resistor. Here, it has to be considered that the partial current flowing over the electrical component may only be a small fractional part of the current passing through the solenoid. Otherwise the solenoid current would be weakened too much and the force acting on the displacement element of the hydraulic machine would be influenced by it. Therefore, the resistance or the impedance of the electrical component, which can be a resistance, a capacitor or an induction coil, has to be high with respect to the corresponding value of the solenoid.

Preferably the electrical component is a resistor which is connected in parallel to the solenoid in the measuring circuit if the displacement element is in its corresponding end position.

BRIEF DESCRIPTION OF THE DRAWINGS

In the following, the invention is explained with the help of embodiments depicted in the Figures. In the depicted embodiments the invention is shown only in the example of a hydraulic machine of the bent axis-type. However, the inventive idea also encompasses hydraulic machines of the swash plate-type, whose displacement element is a swash plate. Needless to say that the inventive idea is also applicable in variable radial piston machines, so this type of hydraulic machine is also encompassed by the inventive idea. The Figures show the following.

DETAILED DESCRIPTION

Figure 1:
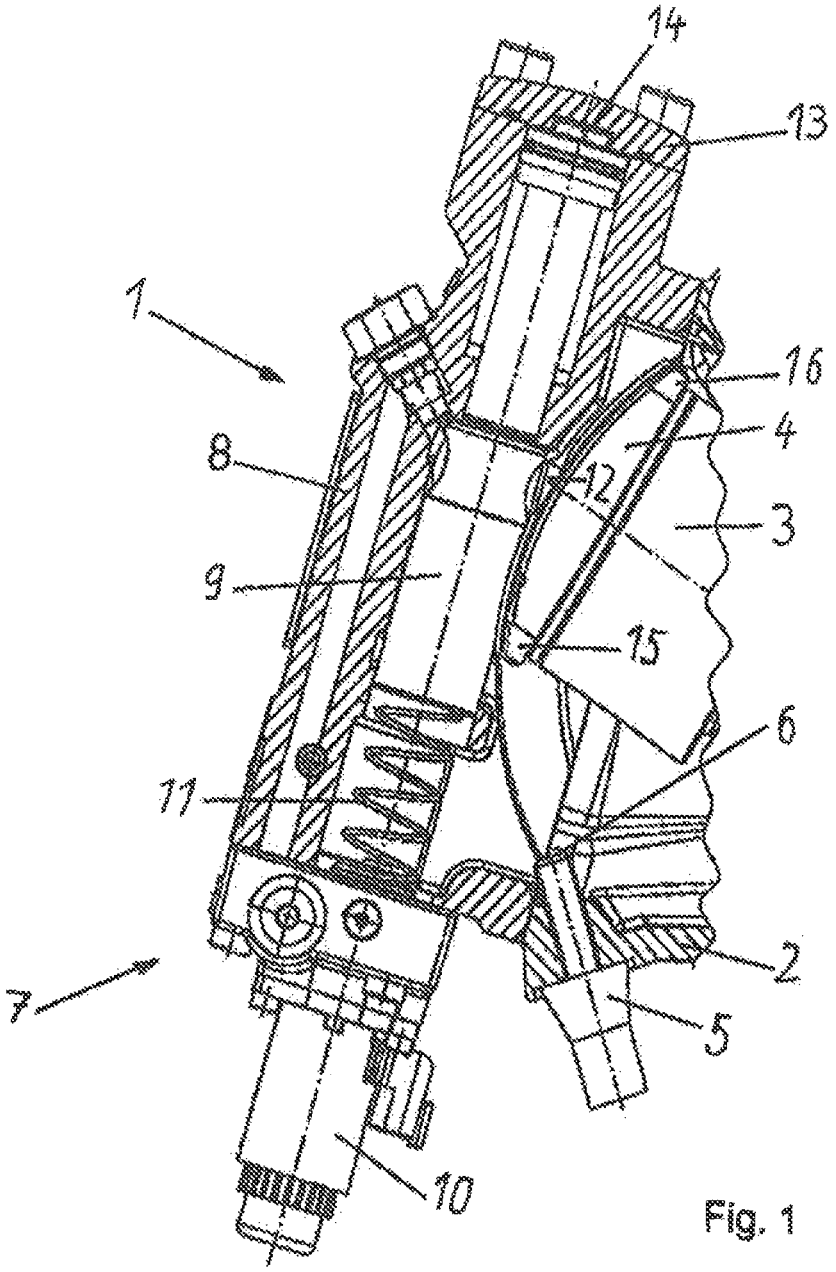
FIG. 1 shows a part of a section view of a hydraulic machine according to the state of the art.

In FIG. 1 shows a detailed view of a variable hydraulic machine 1 of the axial piston type according to the invention in a section view. In a machine housing 2, of which only a small part is shown, a cylinder block 3 is arranged on a yoke 4 for example being a displacement element 4 for hydraulic machines of the bent axis type. The non-shown pistons in the cylinder block 3 are operated in the known manner by a rotating drive mechanism or are driving a driving shaft, according to whether a pump or motor operation of the hydraulic machine is intended. These details are known to a person skilled in the art, such that further explanations hereto are renounced.

Yoke 4 is mounted in housing 2 jointly displaceable with cylinder block 3, wherein the corresponding end positions of displacement are given by adjusting screws 5 or by other fixed or adjustable parts of the hydraulic machine. In FIG. 1 only one adjusting screw 5 is shown exemplarily. Here, the screw is assigned to a minimum angle of displacement. When reaching this minimum angle, a first end portion 15 of the yoke 4 contacts a front face of the adjustment screw 5 thus forming an limit stop 6. It is self-evident that such an adjustment screw can also be assigned to the maximum angle of displacement of yoke 4, against which the second end portion 16 of yoke 4 abuts. In this embodiment yoke 4 plays the role of a displacement element 4.

The displacement of yoke 4 together with cylinder block 3 is effected by means of a displacement unit 7, whose casing 8 is firmly attached to machine housing 2 of hydraulic machine 1. In casing 8 of displacement unit 7 a displacement spool 9 is arranged movable longitudinally. The displacement of displacement spool 9 is controlled by solenoid 10 acting on a control spool. The control spool (not shown) controls in common way fluid flow rates which act on displacement spool 9 and determine its position. Here, a spring 11 is used as a mechanic return. Displacement spool 9 acts via a rod serving as a carrier for yoke 4 of hydraulic machine 1. Thus, an axial displacement of displacement spool 9 leads to a correspondent displacement of yoke 4 and therewith of cylinder block 3. In this manner the displacement or the conveying volume of the cylinders in the cylinder block 3 is adjusted. The control of solenoid spool 10, which is commonly realized as proportional magnet, i.e. its supply with current is done by a not shown electronic control unit with which the hydraulic machine 1 is operated.

According to FIG. 1, as an example, Casing 8 of displacement unit 7 is provided with an end cap 13 serving as an limit stop 14, for example for the maximum displacement of the displacement spool 9. Hence, this limit stop 14 defines the maximum displacement position of yoke 4. Therefore, limit stop 14 can take over the function of an limit stop 6 formed by displacement screw 5. Needless to say that for a person skilled in the art, an analog minimum or maximum displacement position of yoke 4 at limit stop 14 is encompassed by the inventive idea as well.

Figure 2:
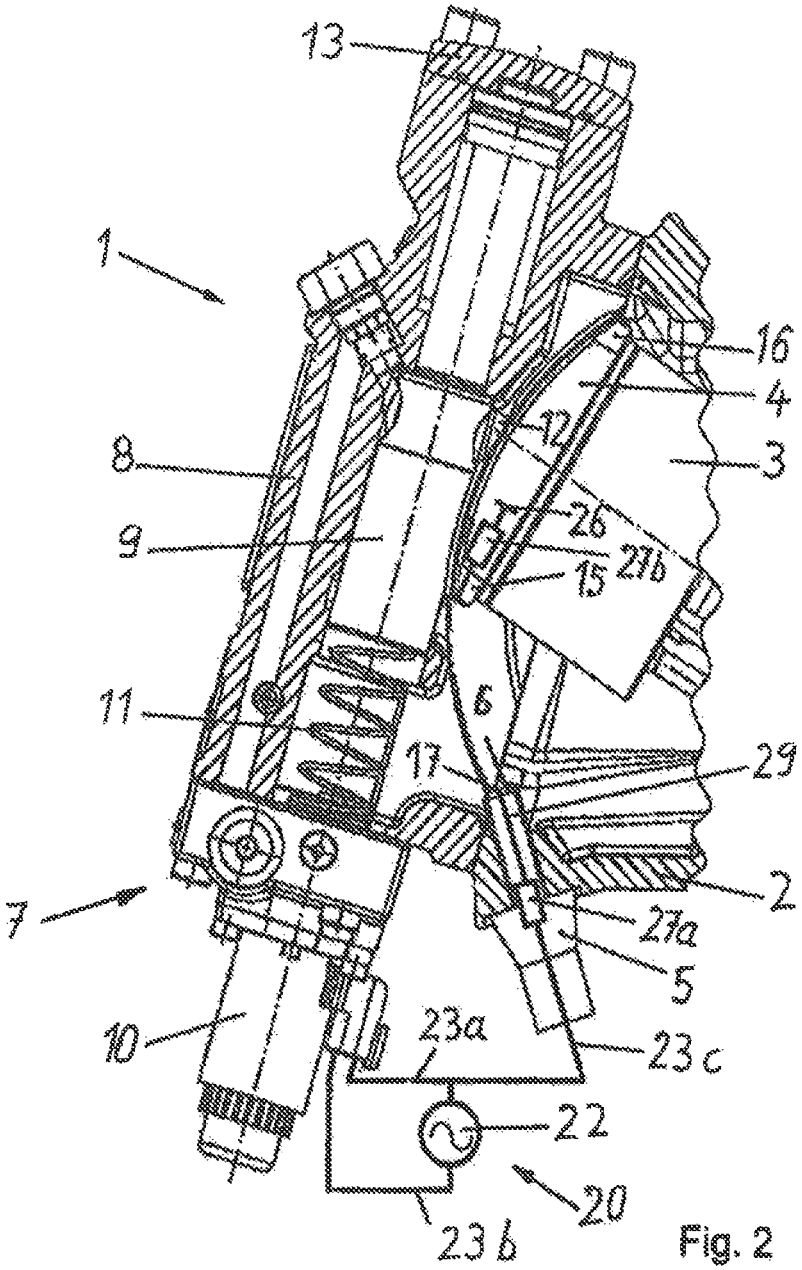
FIG. 2 shows a detail view of one embodiment of the invention.

FIG. 2 shows an inventive hydraulic machine in a partial section view according to FIG. 1. In the following Figures all reference signs are maintained for the denomination of equal structural features. The general structure and way of operation of the hydraulic machine 1 corresponds to the details given by means of FIG. 1.

In FIG. 2 the inventive measuring circuit 20 is shown comprising a current or power source 22. The power source 22 is part of a non-shown electronic control unit of hydraulic machine 1 and, for example, serves as power supply of solenoid 10, with which it is operatively connected via lines 23*a*, 23*b*. Therefore, solenoid 10 forms part of measuring circuit 20. One of line 23*a* or 23*b* is connected to earth, which, for example, is formed by the general earth of hydraulic machine 1. Hereby, one can assume that hydraulic machine 1 consists of metal, hence, being electrical conductive. Earth 26 may be formed by the earth of a not shown electronic control unit for hydraulic machine 1 as well, for example, formed by an inlet pin of a microcontroller for fault monitoring.

The other part of measuring circuit 20 is built according to the invention by a further line 23*c* and, for example, by resistors 27*a* and 27*b* being connectable to ground 26 parallel to solenoid 10. Resistor 27*a* is assigned to adjustment screw 5; Resistor 27*b* to yoke 4. Resistor 27*a* and the corresponding line 23 are mounted electrically isolated within adjustment screw 5, wherein part 29 of line 23*c* ends at front face 17 of adjustment screw 5 serving as an limit stop 6. This part 29 of line 23*c* forms a contact area 30 on front face 17 being electrically isolated from the rest of front face 17. The first end portion 15 of yoke 4 assigned to adjustment screw 5 also shows a contact surface capable to establish electrically conductive contact with contact area 30 of adjustment screw 5. This case occurs if yoke 4 is at the opposite limit stop, for instance in the position of the lowest or biggest displacement, i.e. if end portion 15 of yoke 4 contacts limit stop 6 arranged on front face 17 of adjustment screw 5. In this position a partial current of current or power source 22 is connected via lines 23*c*, 29 and the resistors 27*a* and 27*c* to earth 26. Resistor 27*c* however can be formed by the reduced conductivity of the material of hydraulic machine 1 such that a separate discrete resistor 27*c* can be omitted.

If the electrical contact between the contact areas of yoke 4 and the adjustment screw 5 is closed, as descript already above, a partial current of measuring circuit 20 flows through solenoid 10 and a further partial current flows through the branch of measuring circuit 20 which is built by the lines 23*c* and 29 and the resistors 27*a* and 27*b* to earth 26. This can be identified by a jumpy change in the resistance of measuring circuit 20 in the moment the contact is closed. This change of resistance can be seen for example by a change of current or voltage in the measuring circuit and can be detected by the electronic control unit of the hydraulic machine. Thus, its occurrence is a secure indication that yoke 4 has reached one of its end positions of displacement.

By the selection of the resistors 27*a* and 27*b* it should be considered that the partial current flowing over the same is significantly lower than the current flowing over solenoid 10. Otherwise, with the closed contact between contact area 30 of adjustment screw 5 and the yoke 4, a non-admissible high reduction of current flowing through the solenoid 10 would occur and would lead to a jumpy and undesired change of the displacement angle of yoke 4.

In implementation of the invention it is further possible to substitute resistors 27*a* and 27*b* by capacitors and/or inductivities. Thereby, the change of parameters of the measuring circuit 20 occurring by contact of the adjustment screw 5 with yoke 4 can, for example, detected by a change in frequency or amplitude in the resonant circuit.

Figure 3:
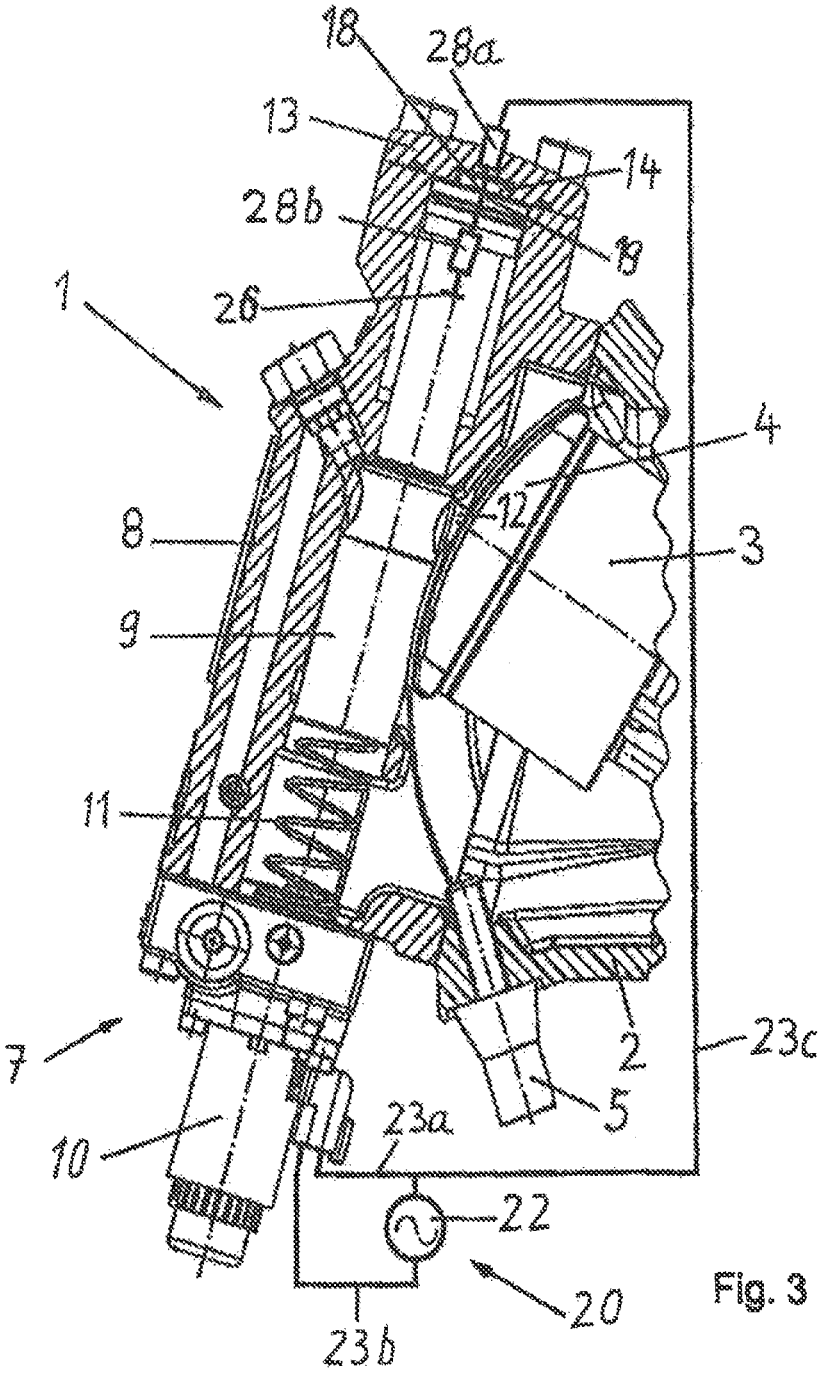
FIG. 3 shows a detail view of a further embodiment of the invention.

In FIG. 3 a further embodiment of the invention is shown, wherein similar parts are denominated with the same reference signs as in FIGS. 1 and 2. As described above, one branch of the measuring circuit 20 is built by magnet coil 10 and lines 23*a* and 23*b* connected to the current or voltage source 22. The other branch of measuring circuit 20 leads over line 23*c* and over resistors 28*a* and 28*b* to earth 26. Here, the resistor 28*a* is arranged in end cap 13 of displacement element 7, wherein its outlet contact is conducted electrically isolated to a contact area 18 of limit stop 14 arranged in end cap 13. As shown in FIG. 3, contact area 19 faces contact area 18 in the end position of displacement spool 9, wherein both contact areas 18, 19 are connected electrically conductive. From contact area 19 in displacement spool 9 an isolated line 31 leads over resistance 28*b* to earth 26. In this embodiment displacement spool 9 functions as displacement element 4. As displacement spool 9 is coupled via rod 12 with yoke 4, the end position of displacement spool 9 corresponds in a functional way to the end position of yoke 4, and, hence, to the one of cylinder block 3.

In FIG. 3 limit stop 14 is depicted as a fixed stopper arranged in end cap 13 or formed by the same. Naturally, this stopper 14 can be adjustable by implementation of the invention. This eventually permits a vernier adjustment of the designated end position of displacement unit 4 and, thus, of cylinder block 3. As can be seen easily by a person skilled in the art, at this limit stop 14 the maximum as well as the minimum angle of displacement of the axial piston machine, i.e. the maximum or the minimum displacement or conveying volume is reached.

Figure 4:
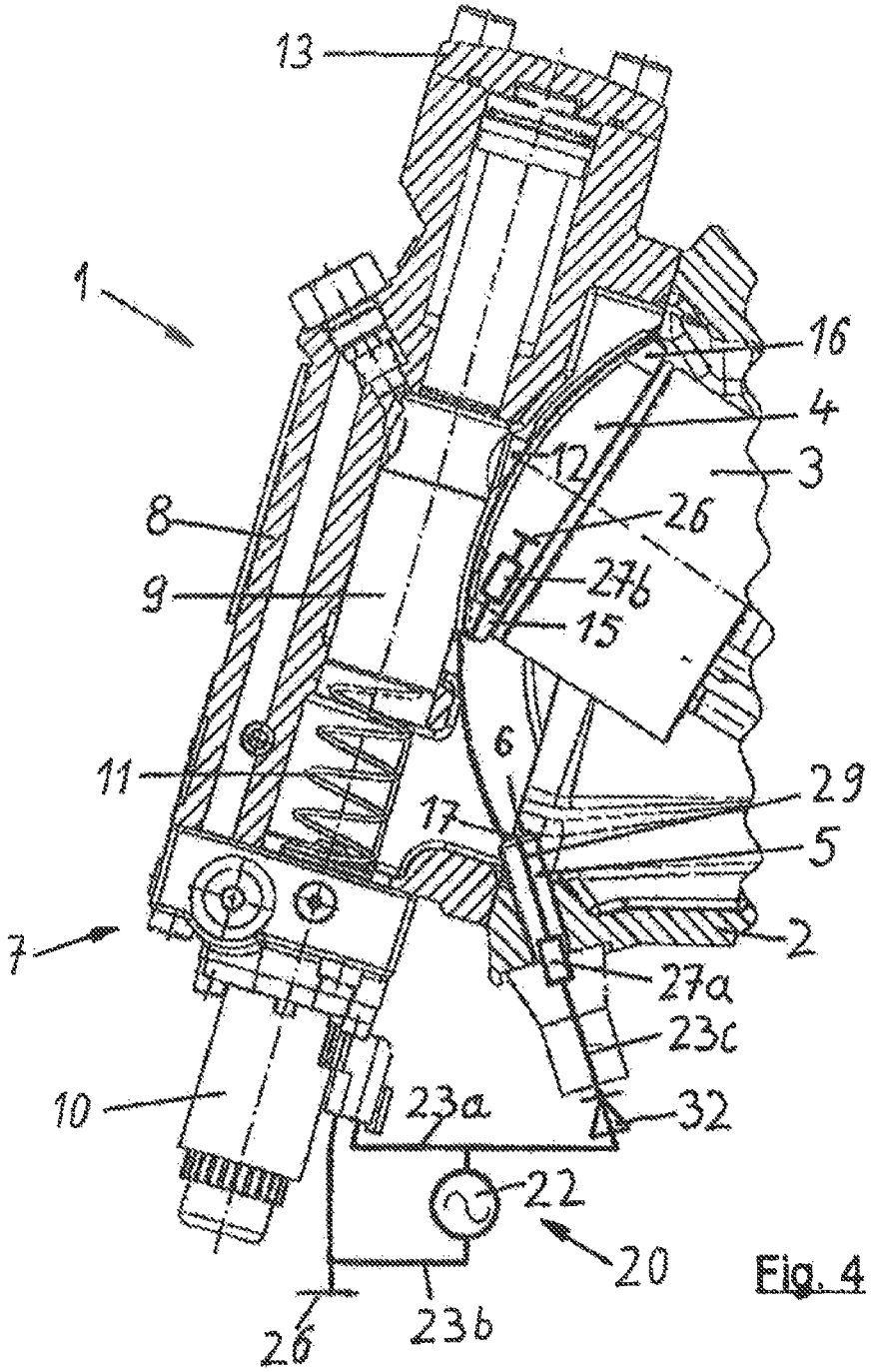
FIG. 4 shows a modification of the embodiment according to FIG. 2.

The embodiment according to FIG. 4 corresponds in structure and function to the one of FIG. 2. However, it differs therefrom by the arrangement of a light emitting diode (LED) 32 or another lighting device arranged in line 23*c* connecting the power source 22 of measuring circuit 20 with electrical component 27*a*. Light emitting diode 32 lights if a contact between electrical component 27*a* and ground 26 is established and indicates that displacement element 4 has reached the end position. Hence, light emitting diode 32 serves as an optical indicator. It is obvious that line 23, only shown schematically in FIGS. 1 to 4, can be conducted through the working machine such that light emitting diode 32 may be arranged for example in an indication area of the electronic control unit of the hydraulic machine. Commonly, the electronic control unit is a separate assembling group of the hydraulic machine being connected with the same via electric lines. For the present explanation of the inventive idea and for simplification reasons only, it is assumed that the electronic control unit is arranged on the hydraulic machine.

The way of operation of this embodiment of the invention is as follows: In a position of displacement spool 9 between the end positions of its displacement no electric conductive contact between the contact areas 18 and 19 in the end cap 13 and in the displacement spool 9 is established. Thus, no current flows through line 23*c* and through resistors 28*a* and 28*b*. However, if the displacement spool reaches the end position, which is shown in FIG. 3, the contact areas 18 and 19 at limit stop 14 and at displacement spool 9 contact each other such that a current via resistors 28*a* and 28*b* flows to earth 26. The caused jumpy change of the situation in the measuring circuit 20 serves for detecting that the displacement spool 9 has reached the end position and, thus, also yoke 4 of the hydraulic machine 1 coupled with displacement spool 9.

In modification of the invention a modification of the conditions in measuring circuit 20 can consist also therein that at the beginning of a take-off of displacement element 4 from its end position, current through the electrical component or through the electrical components stops flowing, as the contact to earth is interrupted. The jumpy reduction of current or of the total resistance in the measuring circuit 20 then constitutes an indication in such regard that the designated end position is left. Such a signal can be used also by the electronic control unit of hydraulic machine 1. This case, for example, occurs if the current in the solenoid is raised continuously in a ramp-like manner beginning at zero current. As the displacement spool commonly starts with a movement only, if the solenoid current reaches a predetermined minimum value, this value has to be reached in order that the displacement spool 9 or the displacement element 4 takes off from the limit stop (contact) and, thereby, interrupting the partial current in that branch of measuring circuit 20. Thus, the inventive method is suitable to indicate the reaching as well as the departure from an end position of displacement elements 4, 9.

As displacement spool 9 preferably consists of metal and is connected electrically conductive via casing 8 or other parts with the overall earth of hydraulic machine 1, in realization of the invention, it is possible to waive resistance 28*b* and to bring contact area 18 at stopper 14 directly into contact with the facing front face of displacement spool 9. In this case the modification of displacement unit 7 is limited to the end cap 13 only, which has to be provided with a resistor 28*a*, a contact area 18 at stopper 14 and with a line 23*c*. The corresponding electrically conductive contact areas 18 and 19 are preferably designed such that they are elevated with regard to the surrounding surface. This guarantees a reliable electric contact if the two contact areas facing each other came into contact.

In implementation of the invention, at least for a person skilled in the relevant art, it is possible without more to combine the two embodiments mentioned above in one hydraulic machine 1. Here, for example, one of both end positions of displacement of displacement element 4, e.g. the yoke 4, in which end portion 15 of yoke 4 abuts against front face 17 of adjustment screw 5 (c.f. FIG. 2), is detected by means of a measuring circuit 20, for example the one according to FIG. 2. The other end position of displacement shown in FIG. 3, corresponding to the other extreme displacement of yoke 4, can be determined, for example, by means of a measuring circuit 20 according to FIG. 3.

Thus, the invention provides with a simple and reliable method for detecting that a displacement element of an adjustable hydraulic machine, e.g. of an axial piston type, has reached an end position of displacement, as well provides with a design of a hydraulic machine suitable for carrying out the method.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for determining of at least one end position of a displacement element of a hydraulic machine displaceable or shiftable between two end positions, the hydraulic machine being variable in its displacement or conveying volume by means of the displacement element, wherein an electric contact between the displacement element and an electric component of an electric measuring circuit is established, when the end position is reached by the displacement element;

the method comprising a step of determining that the end position is reached based on an analyzed change of electrical parameters of the measuring circuit induced by the electrical contact.

2. The method according to claim 1, wherein the electric components comprise a resistance, a capacity or an inductivity.

3. The method according to claim 1, wherein one of the captured parameters is the resistance of the measuring circuit or the current flowing in the measuring circuit.

4. The method according to claim 1, wherein the measuring circuit is a resonant circuit, whose frequency or amplitude is captured.

5. A variable hydraulic machine whose displacement or conveying volume is adjustable by means of a displacement element of a displacement unit, the displacement element displaceable between a first end position and a second end position, wherein the hydraulic machine comprises electrical components forming part of an electrical measuring circuit and are assigned to at least one of both end positions, such that an electrical contact between the electrical components arranged in a machine housing of the hydraulic machine and the displacement element can be established, if the displacement element reaches one of the two end positions.

6. The hydraulic machine according to claim 5, wherein the displacement element comprises electrical components, which can be brought in contact with the electrical components in the machine housing or with a voltage conducting line of the measuring circuit.

7. The hydraulic machine according to claim 5, wherein the hydraulic machine comprises a solenoid, with which the displacement element of the displacement unit is actuable, wherein the solenoid is part of the measuring circuit.

8. The hydraulic machine according to claim 5, wherein the hydraulic machine comprises an electronic control unit, by means of which the current through the solenoid can be set and monitored.

9. The hydraulic machine according to claim 5, wherein the hydraulic machine comprises at least one adjusting screw for determining one of the two end positions of the displacement element, and that a first contact of an electrical component is arranged isolated from a mechanical contact area of the adjustment screw, wherein the contact area can be contacted electrically conductive by the displacement element when the end position is reached.

10. The hydraulic machine according to claim 5, wherein a second contact of the electrical component is connected electrically conductive to the measuring circuit.

11. The hydraulic machine according to claim 5, wherein the electric component is a resistor, a condensator or an inductor.

12. The hydraulic machine according to claim 5, wherein the electric component is a resistor, which is connected electrically parallel to the solenoid in at least one end position of the displacement element.

13. The hydraulic machine according to claim 5, wherein a line, which connects the power source of the measuring circuit with an electrical component, runs via a light emitting electric component, in particular a light emitting diode.

14. The method according to claim 2, wherein one of the captured parameters is the resistance of the measuring circuit or the current flowing in the measuring circuit.

15. The method according to claim 2, wherein the measuring circuit is a resonant circuit, whose frequency or amplitude is captured.

16. The hydraulic machine according to claim 6, wherein the hydraulic machine comprises a solenoid, with which the displacement element of the displacement unit is actuable, wherein the solenoid is part of the measuring circuit.

17. The hydraulic machine according to claim 6, wherein the hydraulic machine comprises an electronic control unit, by means of which the current through the solenoid can be set and monitored.

18. The hydraulic machine according to claim 7, wherein the hydraulic machine comprises an electronic control unit, by means of which the current through the solenoid can be set and monitored.

19. The hydraulic machine according to claim 6, wherein the hydraulic machine comprises at least one adjusting screw for determining one of the two end positions of the displacement element, and that a first contact of an electrical component is arranged isolated from a mechanical contact area of the adjustment screw, wherein the contact area can be contacted electrically conductive by the displacement element when the end position is reached.

20. The hydraulic machine according to claim 7, wherein the hydraulic machine comprises at least one adjusting screw for determining one of the two end positions of the displacement element, and that a first contact of an electrical component is arranged isolated from a mechanical contact area of the adjustment screw, wherein the contact area can be contacted electrically conductive by the displacement element when the end position is reached.

* * * * *